United States Patent [19]

Sherlock et al.

[11] 4,012,063

[45] Mar. 15, 1977

[54] INTERLOCK LATCH ASSEMBLY FOR CENTRIFUGALS

[75] Inventors: John W. Sherlock; George R. Haigh, both of East Moline; Donald L. Ropp, Colona, all of Ill.

[73] Assignee: Ametek, Inc., New York, N.Y.

[22] Filed: Nov. 26, 1975

[21] Appl. No.: 631,691

[52] U.S. Cl. ..... 292/57; 192/136; 292/341.16; 292/DIG. 69

[51] Int. Cl.[2] ..... B04B 7/06

[58] Field of Search ..... 292/57, 59, 60–61, 292/62, 341.16, 341.17, DIG. 69; 210/146; 192/136

[56] References Cited

UNITED STATES PATENTS

| | | | |
|---|---|---|---|
| 2,018,433 | 10/1935 | Aitken | 210/146 |
| 3,092,576 | 6/1963 | Daubman | 192/136 X |
| 3,133,168 | 5/1964 | Jacobson | 292/DIG. 69 |
| 3,486,782 | 12/1969 | Zanussi | 292/DIG. 69 |
| 3,621,963 | 11/1971 | Smith | 192/136 |
| 3,734,290 | 5/1973 | Nelson | 192/136 X |
| 3,915,273 | 10/1975 | Loschengruber | 192/136 X |

*Primary Examiner*—James T. McCall
*Assistant Examiner*—Robert W. Gibson, Jr.

[57] ABSTRACT

An apparatus having a rotatable member is provided with a locking bolt slidably mounted on an access cover pivotally mounted on a housing supporting the rotatable member. The locking bolt is axially displaceable toward a latching mechanism mounted on the housing. The latching mechanism has a latch for securing the bolt in a locked position and a limit switch engageable by a key on the bolt for energizing and de-energizing the power to the rotatable member. An air or fluid operated solenoid means is provided to release the latch but is not actuable when the rotatable member is rotating. A rotary speed sensor is provided to sense the rotary speed of the rotatable member so as to enable the air solenoid to be released when the speed of he rotatable member is zero.

6 Claims, 10 Drawing Figures

INTERLOCK LATCH ASSEMBLY FOR CENTRIFUGALS

The present invention relates to a mechanical electrical interlock for an apparatus, such as centrifugals, having a rotatable member or basket, and more particularly, to a latching mechanism for locking and unlocking a cover providing access to the rotatable member.

It has long been considered desirable to provide safety devices on apparatus having a rotating member, such as various types of centrifugals, in order to prevent access to the rotatable member during rotation. Such safety devices have included switching means which are responsive to the opening of the access cover whereby the drive is de-energized should the cover be opened. Other forms of safety devices include various types of solenoid switches and relays for locking the access cover and which will not be energized once the drive system or the rotating member has been energized. Some such devices are even speed-responsive in that the access cover is unable to be opened while the rotating member is still rotating after its power supply has been shut-off. However, even such speed-responsive interlocks have not been satisfactory under all operating conditions, because, after continued wear or becoming possibly slightly damaged, the interlock may still permit opening of the cover before the speed of the rotating member has been reduced to zero.

It is one of the objects of the present invention to provide an improved mechanical-electrical interlock for apparatus having a rotating member.

It is another of the objects of the present invention to provide a mechanical-electrical interlock particularly adapted for centrifugals.

It is another of the objects of the present invention to provide an improved interlock which will prevent an operator from entering the rotating member until a signal showing zero speed is generated.

According to one aspect of the present invention, an apparatus having a rotatable member or basket enclosed in a housing, has an access cover to the rotatable member mounted on the housing which is pivotable between open and closed positions. Included is a locking bolt on the access cover movable between locked and unlocked positions when the cover is in its closed position. A latching mechanism is provided on the cabinet for latching the locking bolt in its locked position. The latching mechanism includes switch means engageable by the locking bolt when in its locked position for energizing the power circuit for rotating the rotatable member. Means are also provided for actuating the latching means in order to release the latching means. The releasing means are to be energized in response to the rotation of the rotatable means when the rotatable member rotates so that the releasing means cannot be actuated during rotation of the rotatable member. Means are provided for energizing the releasing means when the rotary speed of the rotatable member is zero so that actuation of the release means is prevented while the rotatable member is rotating.

The locking bolt mechanism includes a locking bolt slidably mounted on the access cover and axially displaceable over an edge of the cover. The end of the bolt projecting outwardly of the cover is provided with key means which are engageable with a latching mechanism when the bolt is axially displaced outwardly of the cover. Also, within the latching mechanism are limit switch means engageable by the key means.

Other objects, advantages, and features of the present invention will be apparent from the accompanying description and drawings, which are merely exemplary.

In the drawings.

Proceeding next to the drawings wherein like reference symbols indicate the same parts throughout the various views, a specific embodiment of the present invention will be described in detail.

Figure 1:
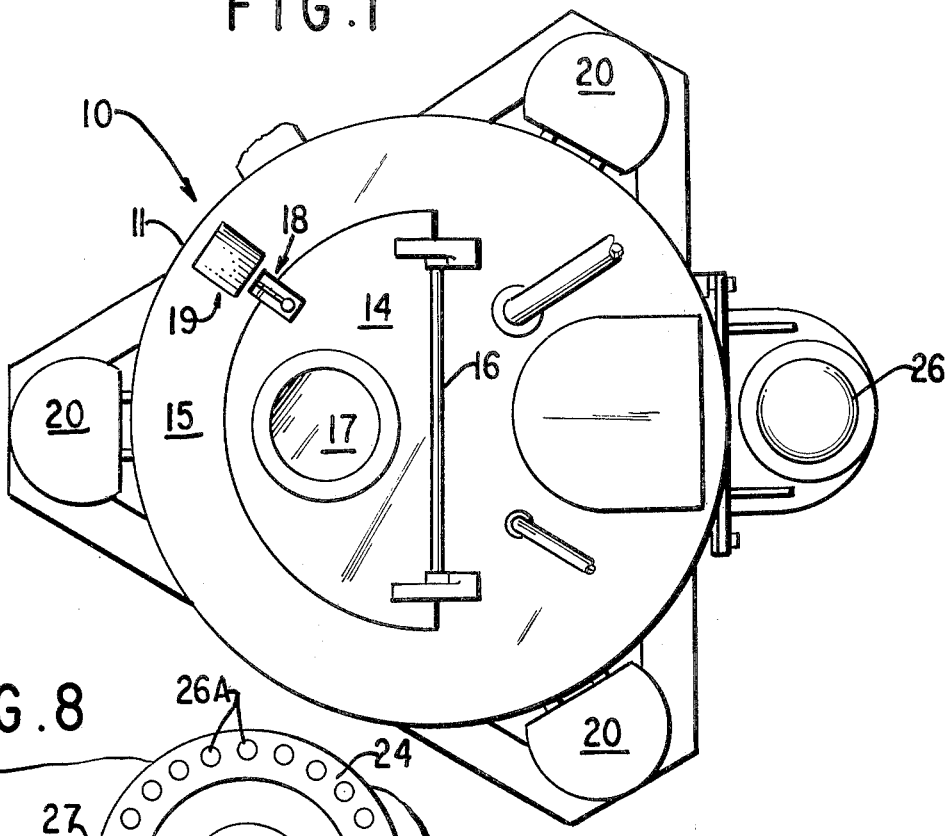
FIG. 1 is a top plan view of a centrifugal apparatus incorporating the present invention.
Figure 2:
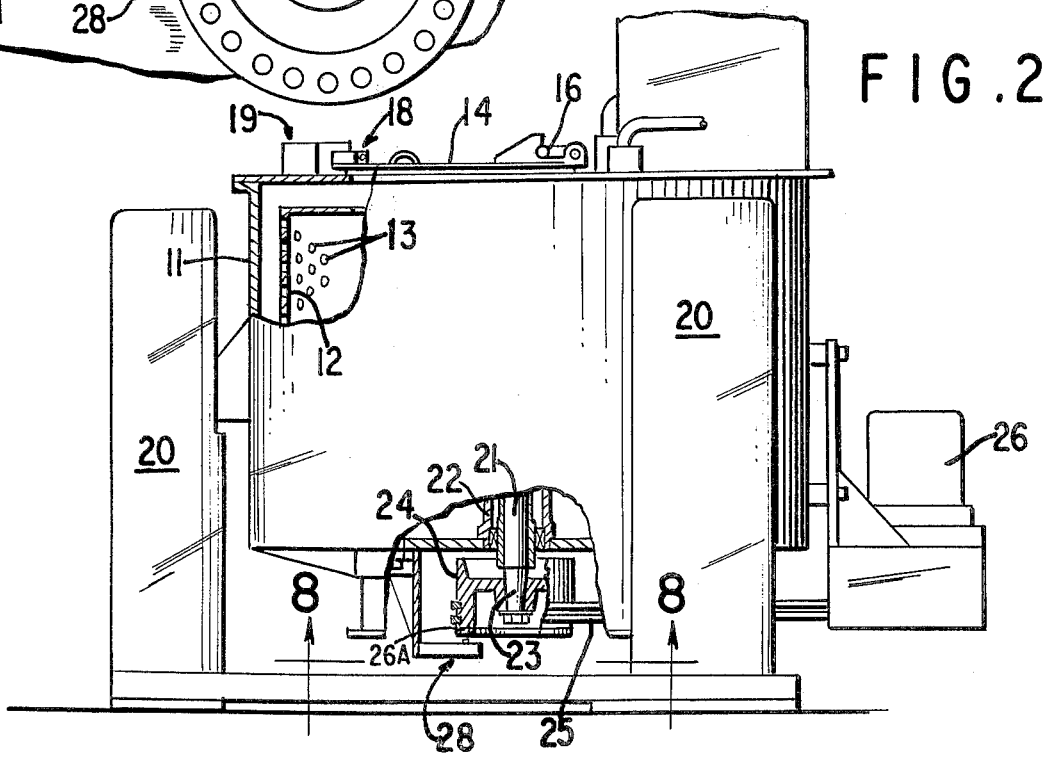
FIG. 2 is a side elevational view of the apparatus of FIG. 1 with portions thereof being cut away.
Figure 3:
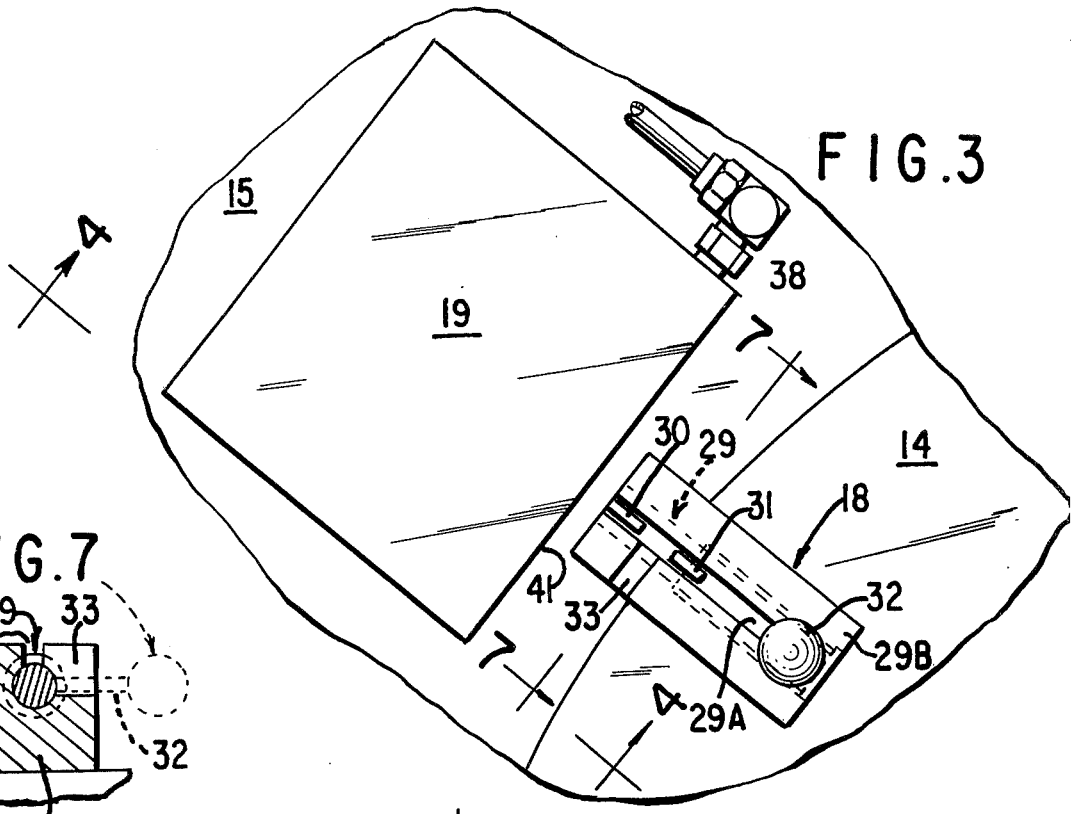
FIG. 3 is a top plan view in enlarged scale of a portion of FIG. 1 showing the locking bolt and latching mechanism according to the present invention.

In FIGS. 1 and 2, an apparatus incorporating the present invention is indicated generally at 10. The apparatus comprises a housing 11 within which is rotatably mounted in a basket 12 which in the form shown has perforated side walls 13 for the purpose of a removal of liquid from material being centrifuged. The invention can be applied to other similar types of apparatus.

Housing 11 is provided with an access door 14 on its upper face 15 with the door being pivotally mounted on shaft 16 for pivotal movement between a closed position as shown in the drawings and an open position. The access cover could be provided with a viewing window 17. Mounted adjacent one edge of the access cover is a locking bolt assembly 18 which will be described presently in greater detail.

The upper surface 15 of the housing has mounted thereon a latching mechanism 19 which will also be described in greater detail. The locations of the bolt assembly 18 and latching mechanism 19 may be reversed wherein the locking bolt assembly 18 is on the upper surface of the housing and the latching mechanism 19 is adjacent one edge of the access cover.

In the form shown, such as seen in U.S. Pat. No. 2.993,580, the housing has a three-point suspension 20 for absorbing vibratory forces and maintaining equilibrium while the basket 12 is rotating. Other types of suspension can be used.

Figure 8:
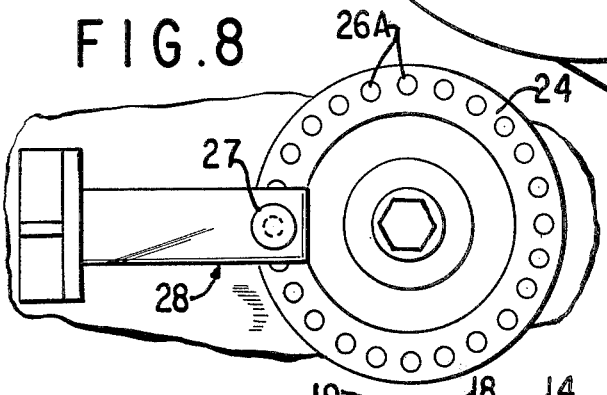
FIG. 8 is a bottom plan view of a portion of the apparatus of FIGS. 1 and 2 looking in the direction of the line 8—8 of FIG. 2.
Figure 9:
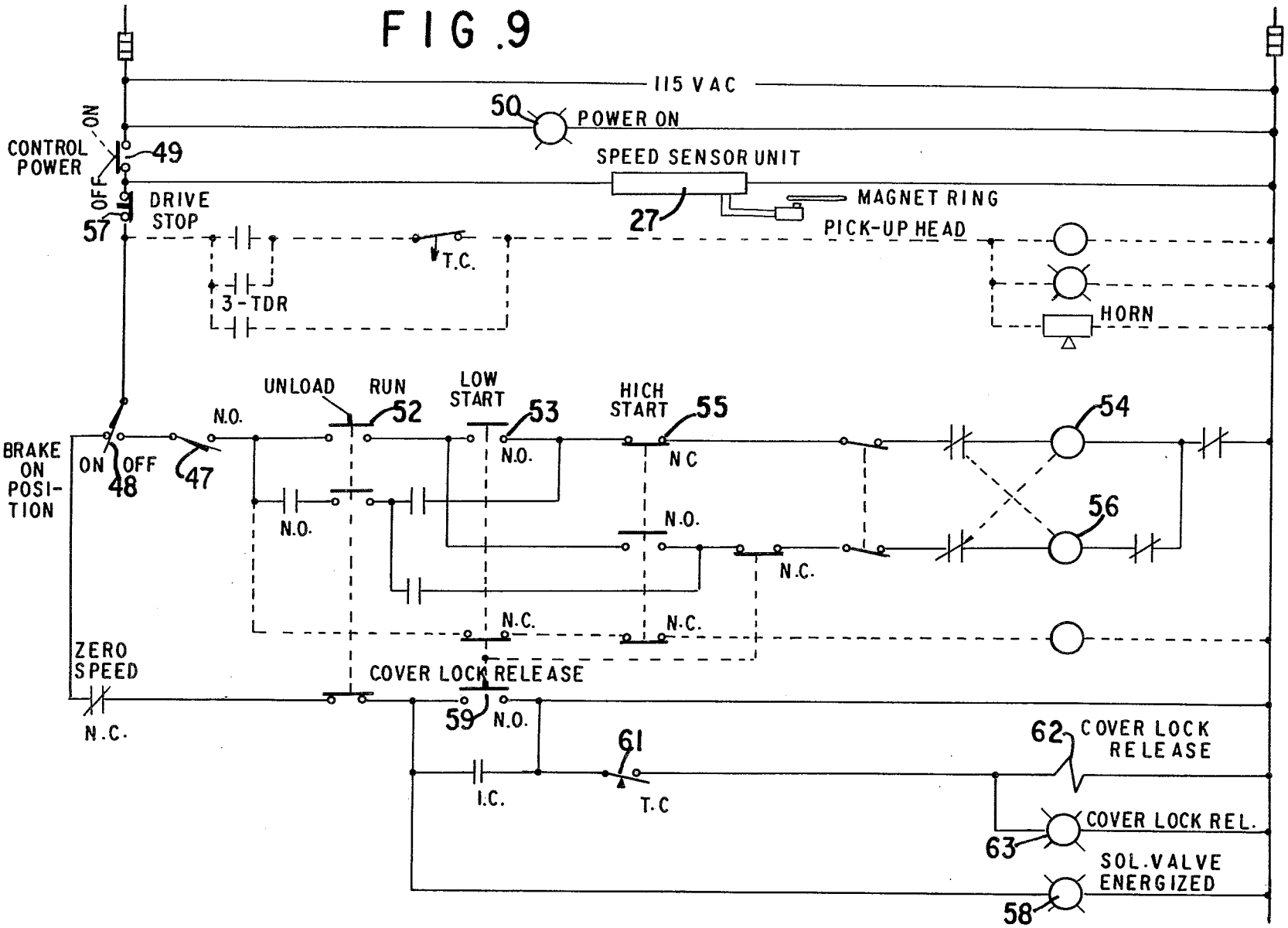
FIG. 9 is an electrical diagram showing schematically the connections between the control components for two-speed operation according to the present invention.

The basket 12 is mounted upon a vertical shaft 21 journaled within the housing 22 and having on its lower end 23 a pulley 24 driven by belts 25 from a motor 26. On the bottom of the pulley 24, there are mounted a plurality of magnets 26A (FIGS. 2, 8) which move past an inductive pick-up sensor head 27 to induce a voltage or signal which is fed to a speed sensor control module or electronic speed sensor 28 (FIGS. 8, 9).

Figure 4:
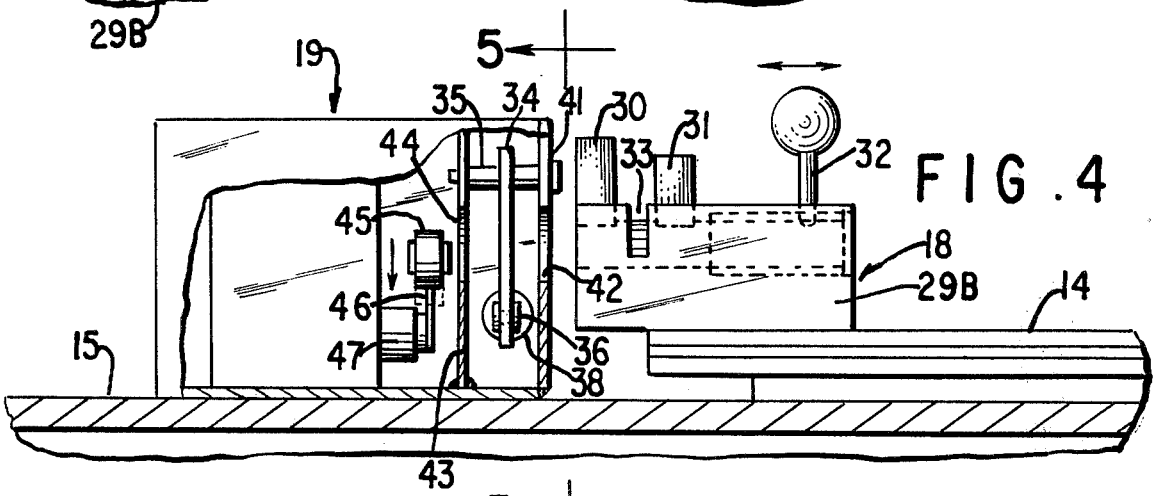
FIG. 4 is an elevational view looking in the direction of line 4—4 of FIG. 3 with a portion of the latching mechanism cut away.
Figure 5:
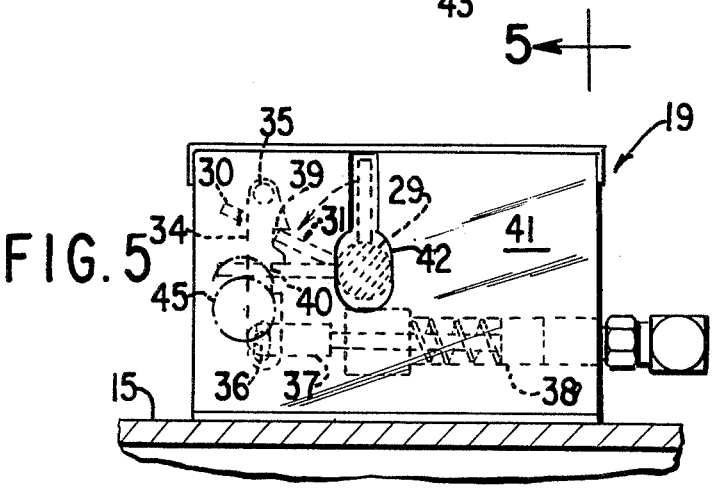
FIG. 5 is a sectional view taken along the line 5—5 of FIG. 4.
Figure 6:
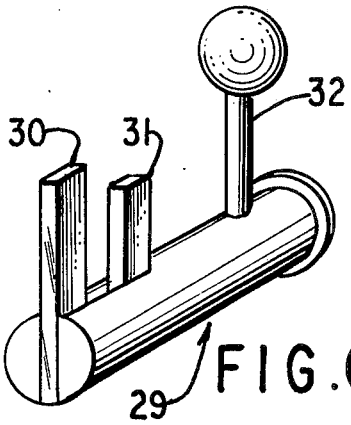
FIG. 6 is a perspective view of the locking bolt shown in FIGS. 3 and 4.

The locking bolt assembly 18 comprises a locking bolt 29 shown in greater detail in FIG. 6 and comprising a cylindrical body portion at one end of which laterally extends a first key 30 and a second key 31 somewhat shorter in length than key 30. Adjacent the other end of the locking bolt is an operating handle 32. The locking bolt is axially displaceable in a similarly shaped opening in the locking bolt assembly between an unlocked position as shown in FIG. 4 and a locked position in which the handle 32 is adjacent and cooperates with a transverse slot 33.

In the locking or locked position, the shorter key 31 is engageable with a latching pawl 34 whose upper end is pivotally mounted on a pin 35 and whose lower end is pivotally connected at 36 to a piston rod 37 of an air or fluid cylinder 38. The locking pawl 34 is provided with a pair of locking notches 39 and 40.

Figure 7:
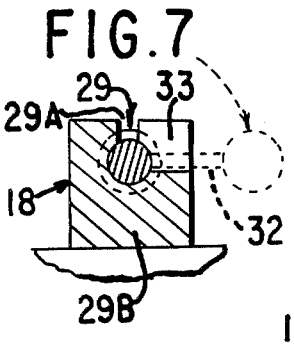
FIG. 7 is a sectional view taken along the line 7—7 of FIG. 3.

When the bolt is slid axially, the keys will slide in slot 29A of guide 29B until cut-out 33 of guide 29B is reached. The handle then can be rotated to the position shown in FIG. 7.

The latching mechanism 19 is provided with an outer wall 41 having an opening 42 through which the locking bolt can enter and an inner partition or baffle 43 having a similarly shaped opening 44 therein. Baffle 43 in the latching mechanism prevents possible passage of any foreign object which may trip the electric limit switch 47, except the key assembly 29.

When the locking bolt is in its locking position, the keys 30 and 31 will be positioned on opposite sides of the wall 43 such that when the bolt is rotated as far as it can go, the longer key 30 will engage a roller 45 on an actuating arm 46 of a limit switch 47 and the shorter key 31 will engage notch 40 of the locking pawl 34 and be held.

As the bolt is turned, key 31 can first be engageable by the first notch 39 of pawl 34 so that the key can not be rotated clockwise and the bolt retracted, even though not turned all the way. Even in this first position, the cover can not be opened until the brake selector switch 48 is in the "brake-on" position, the selector switch 52 "unloaded-run" is in the unload position, and the cover release button 59 is pressed so as to activate the cover lock solenoid valve to admit air to cylinder 38.

As the turning of the bolt is continued to its complete counterclockwise position, as mentioned above, key 30 will activate switch 47 and key 31 will be engaged by notch 40 of the pawl 34. Again, the key can not be withdrawn and cover unlocked until the various conditions are reached as described above when engaged in the first notch 39.

By use of the first notch as well as the second, an improper operation of the limit switch or withdrawal of the bolt can not be accomplished until the described safety sequence takes place and the basket has stopped.

According to the present invention, an operator is prevented from entering the rotating member 12 until a signal has been generated that indicates zero speed.

For two-speed operation utilizing the circuit of FIG. 9, the sequence of operation can be summarized as follows:

Closing of the access cover 14 and latching the locking bolt key 29 in the interlock as described in the limit switch contacts 47 will close to make energization possible of an electrical circuit to start the apparatus. As the basket accelerates, the magnetic sensor 27 will open a relay contact to further assure that the air solenoid means cannot be actuated to release the latch. As a result, the locking bolt cannot be unlatched.

As the apparatus is stopping and upon deceleration of the basket 12, the basket must reach zero speed and may include a time delay of a relay before closing contacts so that an air solenoid can be energized to release the latch mechanism 19 to allow the locking bolt 29 to be withdrawn to unlock the access cover.

As an example, the start sequence of the apparatus including the interlock according to the present invention is as follows:

Control power switch 29 is moved to the "on" position to energize the power-on light 50 and the speed sensor unit 27.

The cover 14 is then closed and locked by sliding the locking bolt 29 axially into engagement with the latching mechanism 19. Accordingly, cover lock switch 51 moves from its unlocked position as shown in FIG. 9 into its locked position.

Brake lever switch 48 is then moved to the "off" position.

Position unload-run selector switch 52 is moved to the "run" position.

Low speed start switch 53 is pressed to its closed position and held momentarily about three seconds in order to energize the starter coil 54 to thus energize the low speed motor winding. When the basket speed sensor 27 detects that the basket is rotating, its output relay energizes and thus completes the holding circuit for the motor starter 56.

The basket is then loaded.

High speed start switch 55 is then pressed to de-energize the speed starter coil 54 and energize the high speed starter coil 56 to enable the apparatus to accelerate to a high speed.

In order to stop the rotating basket, stop drive switch 57 is pressed and brake lever 48 actuated to its on position.

In order to open the access cover 14, the stop switch 57 must be pressed only if the motor is still running.

Brake switch 48 is positioned to on.

The selector switch 52 is positioned to "unload."

As the rotating basket comes to a complete stop, the zero speed light 58 will be energized. The cover lock release switch 59 is now pressed to energize on delay timer 61. When timer 61 times out, it will energize cover lock release solenoid 62 and the cover lock release light 63.

When the cover release light 63 is energized, the cover lock bolt key 29 may now be removed to the unlocked position and the cover 14 may now be opened.

Figure 10:
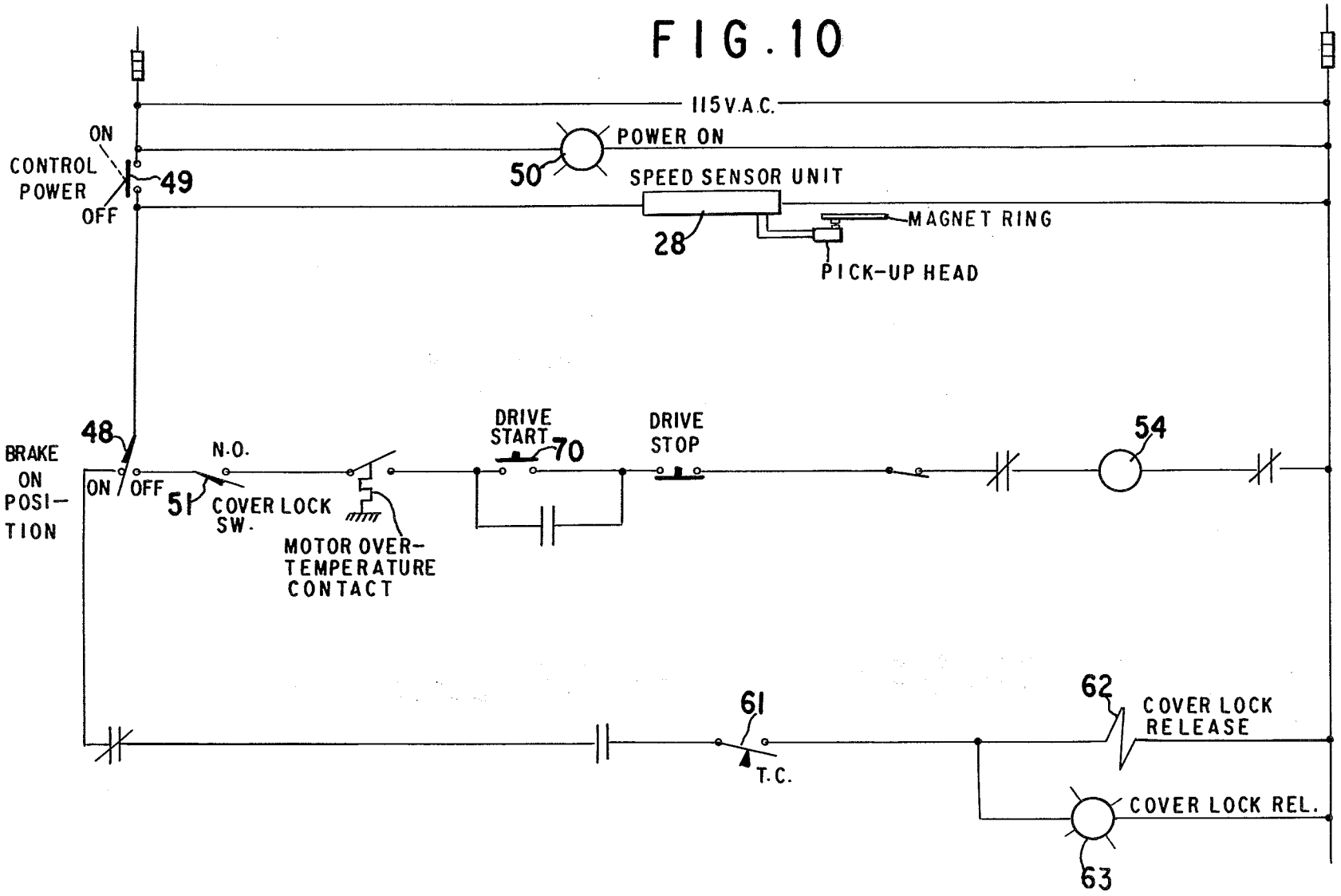
FIG. 10 is an electrical circuit diagram similar to that of FIG. 9 but showing the connections between the control components for single speed operation.

The operation of the invention utilizing a single speed operation circuit is illustrated in FIG. 10 is similar to the operation of the circuit of FIG. 9 as described above but some of the steps are omitted. In the start sequence of the single speed apparatus, the "drive start" button 70 is pressed to its closed position in order to energize the speed motor winding. In stopping, it is only necessary to position the brake lever to the on position. In order to open the cover, it is not necessary to actuate the "drive stop" switch.

The invention may also be utilized with a variable speed control circuit. The two-speed circuit of FIG. 9 can be readily modified as known in the art in order to provide variable speed operation.

Thus, it can be seen that the present invention has disclosed a novel and improved mechanical interlock which is particularly adapted for rotating apparatus such as centrifugals, and the like.

It will be understood that various details of construction and arrangement of parts may be changed without departing from the spirit of the invention except as defined in the appended claims.

What is claimed is:

1. In an apparatus having a rotatable member enclosed in a housing and actuable by power means and an access cover to said rotatable member mounted on said housing and pivotable between open and closed positions, the combination of a slidable and rotatable locking bolt on one of said access cover and said housing and slidably and rotatably movable between locked and unlocked positions when the cover is in its closed position, first and second keys on the inner end of said bolt, pivoted pawl latching means on the other of said housing and access cover for latching said locking bolt in its locked position for energizing said power means, fluid operated means pivoted to one end of and for means actuating said pawl latching means for releasing said latching means, means responsive to the rotation of said rotatable member for prevention of energization of said releasing means when the rotatable member rotates so that said releasing means cannot be actuated during rotation of the rotatable member, and means for energizing said releasing means when the rotary speed of said rotatable member is zero so that actuation of said release means is prevented while said rotatable member is rotating.

2. In an apparatus as claimed in claim 1 wherein there is at least one notch in said pawl, and a key on said locking bolt engageable with said pawl notch.

3. In an apparatus as claimed in claim 2 wherein said rotatable member is supported in said housing with an access cover to said rotatable member on said housing and pivotable between open and closed positions, comprising a locking bolt slidably mounted on the access cover and axially displaceable over the edge of the cover, spaced key means on an end of said bolt projecting laterally outwardly of said cover, a latch on the housing engaged by said key means when the bolt is axially displaced outwardly of the cover, and pivoted pawl limit switch means adjacent said latch and engageable by said key means.

4. A latch mechanism as claimed in claim 3 wherein said bolt is pivotable when in its axially outwardly displaced position.

5. A latch mechanism as claimed in claim 3 wherein said key means comprises first and second spaced keys, said first key engageable with said limit switch and said second key engageable with said latch.

6. A latch mechanism as claimed in claim 3 wherein said key means comprises first and second spaced keys, said first key being engageable with said latch when said key means is only partially inserted into said latch.

* * * * *